US005696547A

United States Patent [19]

Takeda et al.

[11] Patent Number: 5,696,547

[45] Date of Patent: Dec. 9, 1997

[54] RECORDING APPARATUS WITH AUXILLIARY RECORDING AND METHOD THEREOF

[75] Inventors: Tomoyuki Takeda, Yokohama; Takehiro Yoshida, Tokyo; Takeshi Ono, Yokohama; Makoto Kobayashi, Tama; Satoshi Wada, Kawasaki; Yasushi Ishida, Tokyo; Minoru Yokoyama, Yokohama; Akihiro Tomoda, Yokohama; Masakatsu Yamada, Yokohama; Takashi Awai, Yokohama, all of Japan

[73] Assignee: Canon Kabushiki Kaishi, Tokyo, Japan

[21] Appl. No.: 114,239

[22] Filed: Sep. 1, 1993

Related U.S. Application Data

[63] Continuation of Ser. No. 551,165, Jul. 11, 1990, abandoned.

[30] Foreign Application Priority Data

Jul. 14, 1989 [JP] Japan ..... 1-180526
Jun. 25, 1990 [JP] Japan ..... 2-164255

[51] Int. Cl.[6] ..... B41J 2/38

[52] U.S. Cl. ..... 347/186

[58] Field of Search ..... 346/76 PH, 140, 346/1.1; 400/120, 126; 347/185, 186, 187, 215, 227

[56] References Cited

U.S. PATENT DOCUMENTS

| | | | |
|---|---|---|---|
| 4,449,136 | 5/1984 | Moriguchi et al. | 347/186 |
| 4,463,359 | 7/1984 | Ayata et al. | 347/56 |
| 4,520,373 | 5/1985 | Ayata et al. | 347/13 |
| 4,531,133 | 7/1985 | Leng | 347/186 |
| 4,568,817 | 2/1986 | Leng et al. | 347/186 |
| 4,636,810 | 1/1987 | Asakura et al. | 347/188 |
| 4,760,462 | 7/1988 | Ogawa | 347/188 |
| 4,814,789 | 3/1989 | Ono | 347/188 |
| 4,875,056 | 10/1989 | Ono | 347/180 |
| 4,963,884 | 10/1990 | Kiguchi et al. | 347/185 |
| 5,019,836 | 5/1991 | Iwata et al. | 347/186 |

FOREIGN PATENT DOCUMENTS

| | | | |
|---|---|---|---|
| 0027772 | 2/1982 | Japan . | |
| 0181365 | 10/1983 | Japan . | |
| 0211473 | 12/1983 | Japan . | |
| 96976 | 6/1984 | Japan | 347/185 |
| 0067178 | 4/1985 | Japan . | |
| 61-197256 | 9/1986 | Japan . | |
| 0003969 | 1/1987 | Japan . | |
| 62-3969 | 1/1987 | Japan . | |
| 0094360 | 4/1987 | Japan . | |
| 0257863 | 11/1987 | Japan . | |
| 0173669 | 7/1988 | Japan . | |
| 0128856 | 5/1990 | Japan . | |

*Primary Examiner*—N. Le
*Attorney, Agent, or Firm*—Fitzpatrick, Cella, Harper & Scinto

[57] ABSTRACT

A thermal transfer recording apparatus for image recording on a recording medium by transferring the ink of an ink sheet onto said recording medium, comprises ink sheet transport means for transporting said ink sheet, recording medium transport means for transporting said recording medium, recording means for effecting said ink sheet thereby recording an image on said recording medium, timer means for measuring time after image recording by said recording means, heat generation means for driving said recording means to effect heat generation with same data as in the preceding image recording prior to a next recording operation when a predetermined time is measured by said timer means, and control means adapted, when a time exceeding said predetermined time is measured by said timer means, to control the energy for driving said recording means prior to the next recording operation according to the time measured by said timer means.

14 Claims, 12 Drawing Sheets

| FIG. 5A |
| --- |
| FIG. 5B |

| FIG. 8A |
| --- |
| FIG. 8B |

RECORDING APPARATUS WITH AUXILLIARY RECORDING AND METHOD THEREOF

This application is continuation of application Ser. No. 07/551,165 filed Jul. 11, 1990, now abandoned.

BACKGROUND OF THE INVENTION

1. Field of the Invention

The present invention relates to a thermal transfer recording apparatus and a facsimile apparatus, capable of recording an image on a recording medium by transferring ink supported by an ink sheet onto said recording medium.

Said thermal transfer recording apparatus is applicable not only to said facsimile apparatus but also to an electronic typewriter, a copying apparatus, a printer or the like.

2. Related Background Art

In general the thermal transfer printer utilizes an ink sheet composed of heat-fusible (or heat-sublimable) ink coated on a substrate film, and records an image by selectively heating said ink sheet with a thermal head corresponding to the image signal and transferring thus fused (or subliming) ink onto a recording sheet. Since said ink sheet is generally so-called one-time sheet of which ink is completely transferred to the recording sheet in one image recording, it is necessary, after recording of a character or a line, to advance the ink sheet corresponding to the length of recording thereby securely bringing an unused portion of the ink sheet to the next recording position. This operation increase the amount of consumption of the ink sheet, so that the running cost of such thermal transfer printer tends to be higher than that of the ordinary thermal printer utilizing the thermosensitive paper.

For resolving such drawbacks, there is already proposed a thermal transfer printer in which the recording sheet and the ink sheet are advanced with a mutual speed difference, as disclosed in the Japanese Laid-open Patent Applications Nos. 57-83471 and 58-201686, and in the Japanese Patent Publication No. 62-58917. Also as disclosed in the above-mentioned patents, there is already known so-called multi-print ink sheet capable of plural image recording operations (n times) at a same position. Such ink sheet allows, in a continuous recording of a length L, to maintain the length of said ink sheet transported during or after said image recording smaller than said length L (L/n: n>1). Thus the efficiency of use of the ink sheet can be improved to n times in comparison with the conventional ink sheet, whereby a decrease in the running cost of thermal transfer printer can be expected. Such recording is hereinafter called multi-printing method.

In such multi-printing with such multi-printing ink sheet, the ink of the ink layer thereof is heated n times, and the ink transfer onto the recording sheet is conducted by generating a shearing force, at each heating, between the fused (or subliming) ink and the unfused ink of the ink layer. Consequently, if the temperature of the ink is lowered due to a prolonged interval from a line recording to the recording of a next line, the shearing force between the fused (or subliming) ink and unfused (or unsubliming) ink increases, thus rendering the separation of the ink sheet and the recording sheet more difficult. Such difficulty becomes more evident when the black information is present in a larger amount in the recording data of a line, and occurs more frequently in an apparatus in which the interval from the recording of a line to the start of recording of a next line is not constant but tends to become long, such as the facsimile apparatus.

For resolving such difficulty, it is proposed, after the recording operation, to repeat the recording of same data while the recording medium is stopped, and to heat the recording means in the interval before the next recording operation when the recording operation is not conducted over a predetermined period. However if the information of the original is large and is transmitted in plural divided blocks, such as the reception in the error correction mode (re-sending of a block containing error) in the facsimile, the interval between a recording operation and a next recording operation becomes considerably long. In such case, the above-explained measures are unable to provide satisfactory image quality. Also the difficulty in the separation of the ink sheet and the recording medium leads to so-called "adhesion" problem.

SUMMARY OF THE INVENTION

An object of the present invention is to provide a thermal transfer recording apparatus capable of providing a clear recorded image.

Another object of the present invention is to provide a thermal transfer recording apparatus and a facsimile apparatus capable of satisfactorily transporting the recording medium.

Still another object of the present invention is to provide a thermal transfer recording apparatus and a facsimile apparatus capable of satisfactorily transporting the ink sheet.

Still another object of the present invention is to provide a thermal transfer recording apparatus and a facsimile apparatus, capable of controlling the energy supplied to recording means according to the interval of recordings, by effecting heat generation of the recording means in the interval before a next recording operation if the recording operation is interrupted at least for a predetermined period A after a recording operation, and by increasing the energy applied to the recording means in case said interval exceeds a predetermined period B (B>A), thereby improving the quality of the recorded image and facilitating the separation of the recording medium and the ink sheet.

DETAILED DESCRIPTION OF THE PREFERRED EMBODIMENTS

The thermal transfer recording apparatus of the present invention to be explained in the following measures the interval, after an image recording with recording means, to a next image recording, and, upon measuring a predetermined interval, executes heat generation by said recording means again with same data immediately before the next image recording, and, upon measuring a time exceeding said interval, regulates the energy for driving the recording means in the next recording operation according to the measured time.

The present invention will now be clarified in detail by preferred embodiments thereof shown in the attached drawings.

[Description of facsimile apparatus (FIGS. 1–4)]

Figure 1:
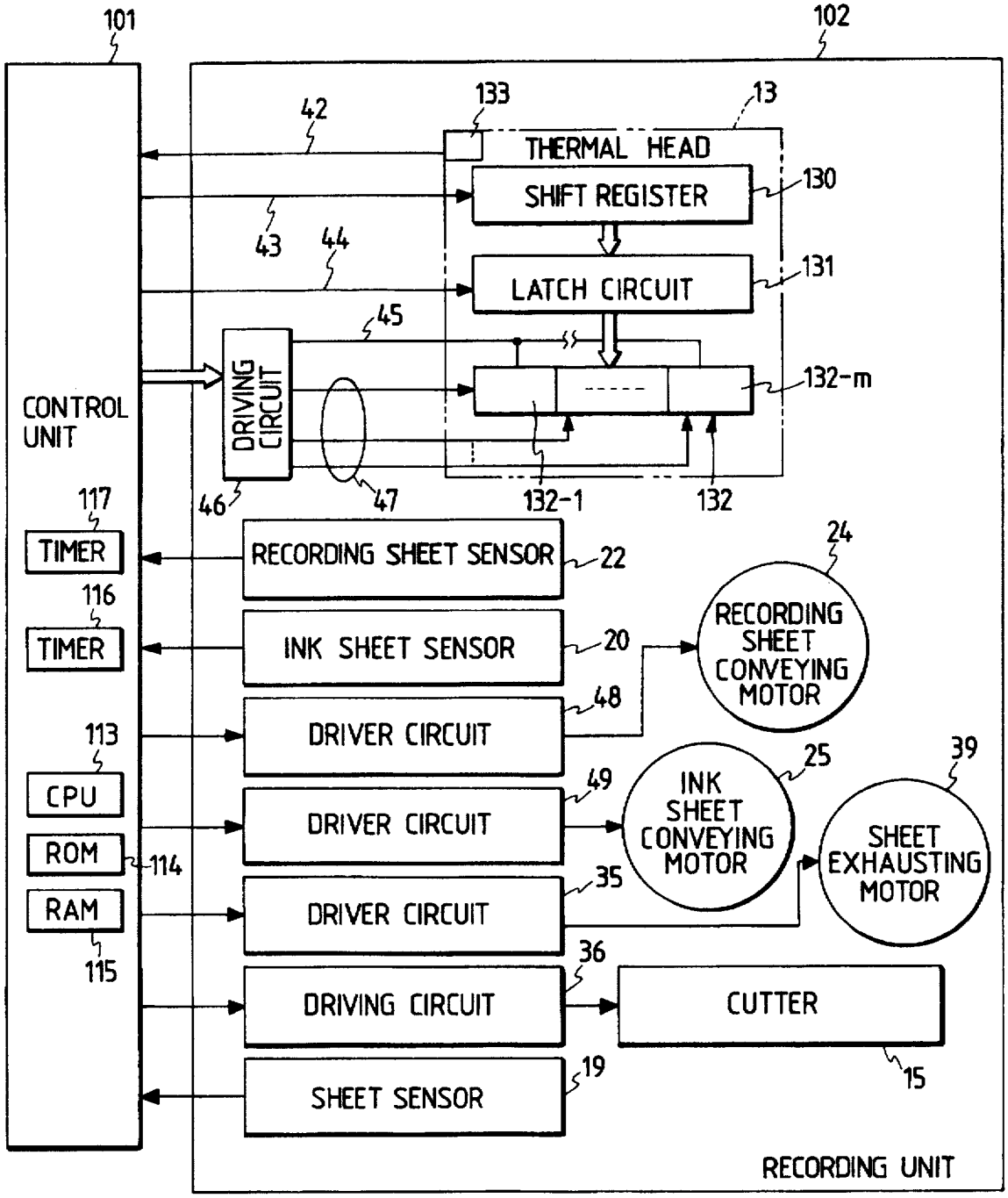
FIG. 1 is a block diagram showing electrical connections between a control unit and a recording unit of an embodiment.
Figure 2:
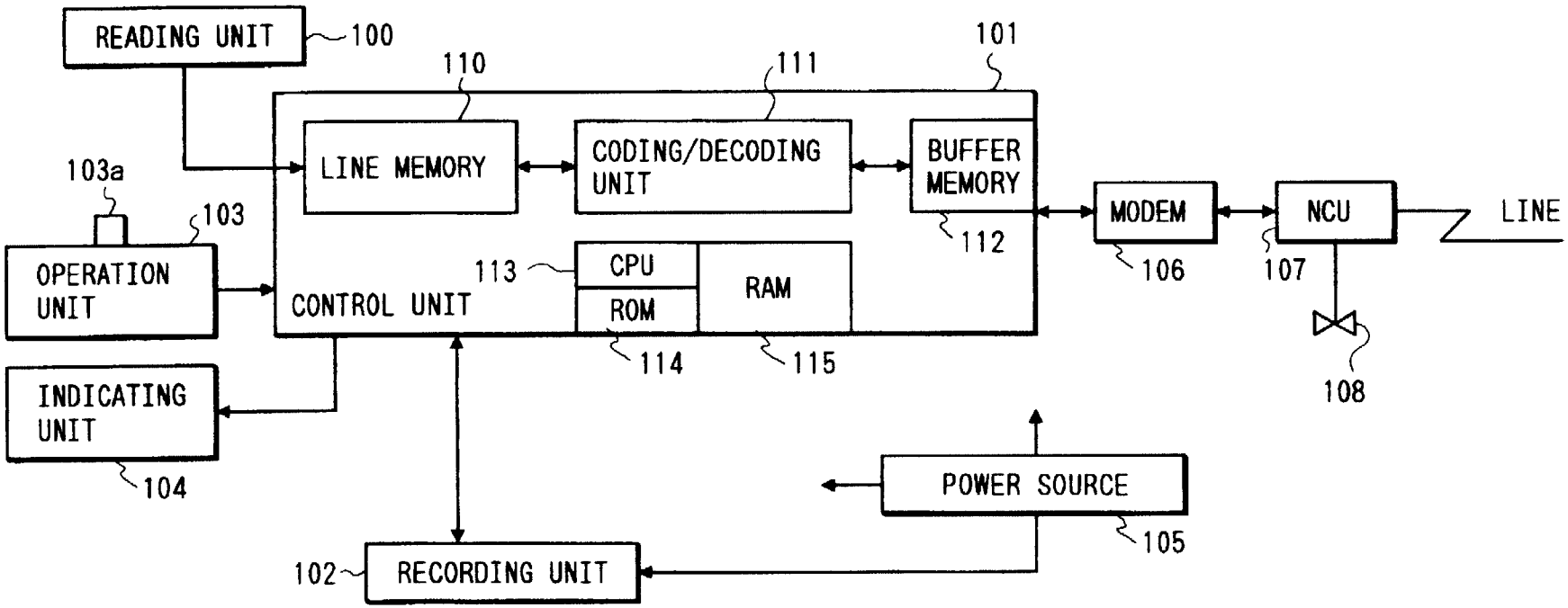
FIG. 2 is a block diagram of the facsimile apparatus of said embodiment.
Figure 3A:
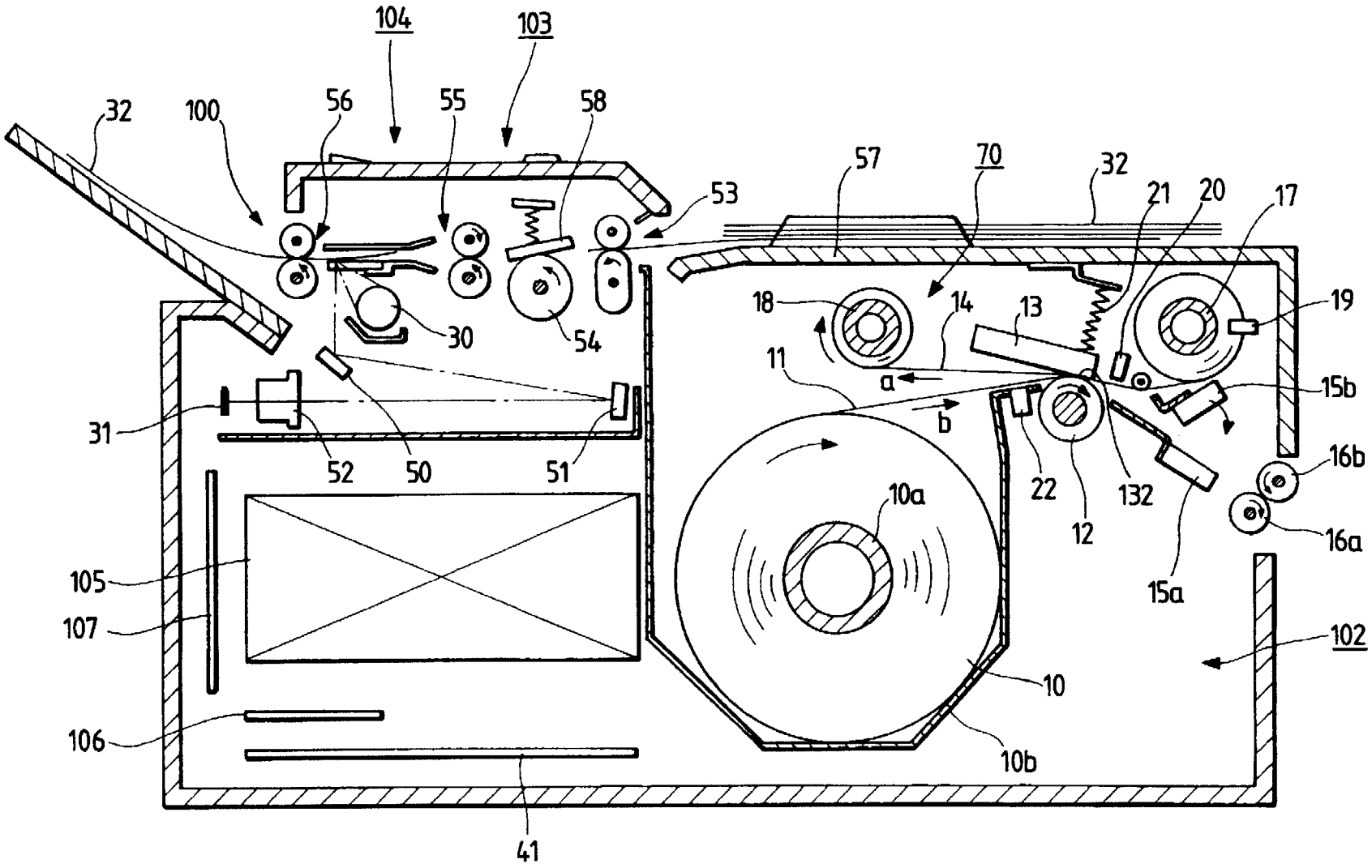
FIG. 3A is a lateral cross-sectional view showing the structure of the facsimile apparatus of said embodiment.
Figure 3B:
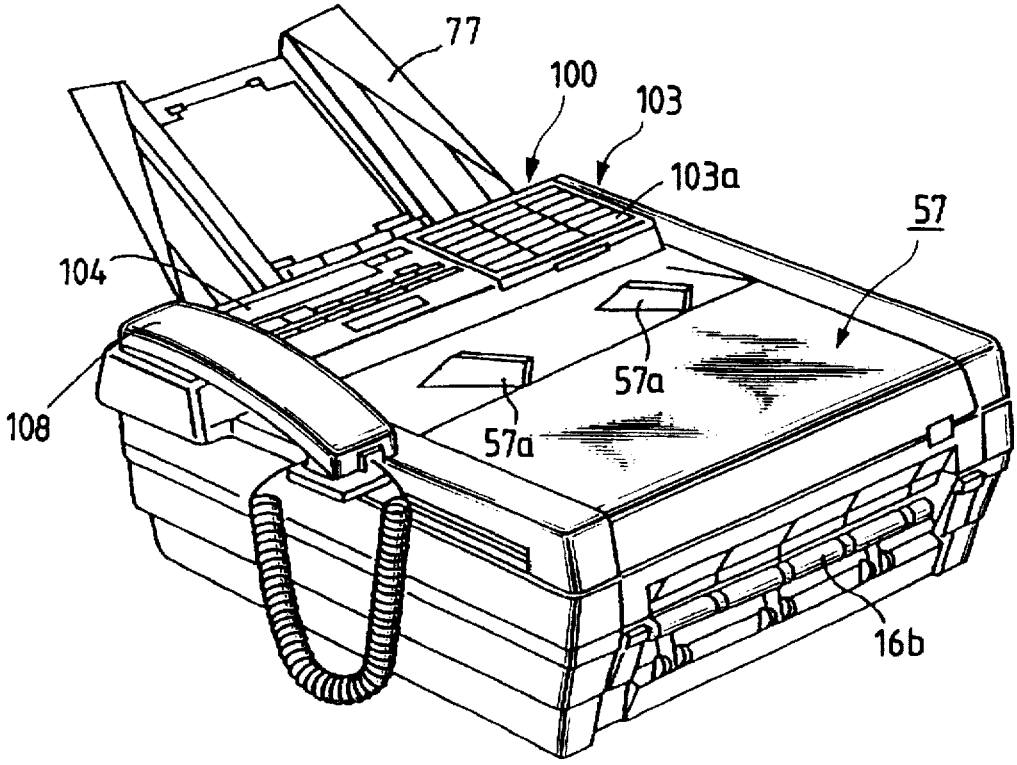
FIG. 3B is an external perspective view of said facsimile apparatus.
Figure 4:
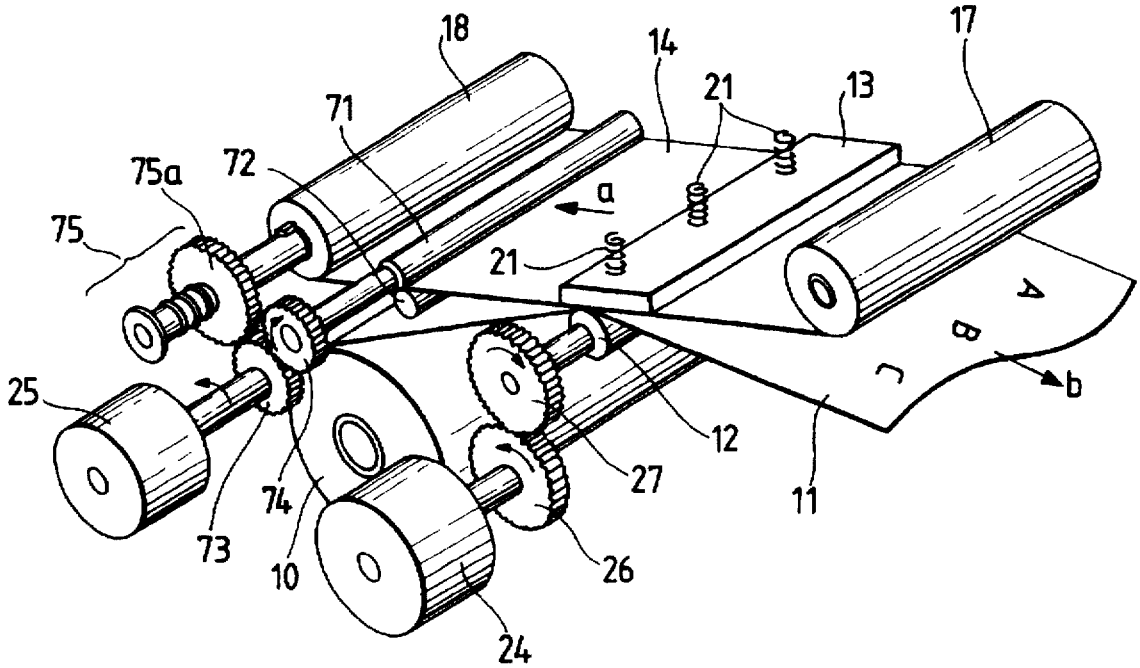
FIG. 4 is a perspective view of a transport system for the ink sheet and the recording sheet.

FIGS. 1 to 4 illustrate a thermal transfer printer embodying the present invention, applied to a facsimile apparatus, wherein FIG. 1 is a block diagram showing electrical connections between a control unit 101 and a recording unit 102 of said facsimile apparatus; FIG. 2 is a schematic block diagram of said facsimile apparatus; FIG. 3A is a lateral cross-sectional view thereof; FIG. 3B is an external perspective view thereof; and FIG. 4 is a perspective view of a transport system for the recording sheet and the ink sheet.

At first reference is made to FIG. 2 for explaining the schematic structure of the facsimile apparatus.

A reading unit 100 photoelectrically reads the original image and sends the obtained digital image signal to a control unit 101 of the same apparatus (in case of copy mode) or another apparatus (in case of facsimile mode), and is equipped with an original transporting motor, a CCD image sensor etc. The control unit 101 is constructed in the following manner. A line memory 110, for storing image data of a line, stores the image data of a line from the reading unit 100 in case of original image transmission (in facsimile mode) or copying (in copy mode), or the received and decoded image data of a line in case of image data reception. The image formation is conducted by the transfer of the stored data to a recording unit 102. An encoding/decoding unit 111 encodes the image information to be transmitted for example by MH encoding, and decodes the received image codes into image data. A buffer memory 112 is used for storing the encoded image data which are to be transmitted or are received. These components of the control unit 101 are controlled by a CPU 113 composed for example of a microprocessor. In addition to said CPU 113, the control unit 101 is provided with a ROM 114 storing control program of the CPU 113 and various data, and a RAM 115 for temporarily storing various data as a work area for the CPU 113.

A recording unit 102 is provided with a thermal line head, having plural heat-generating elements 132 over the width of recording, and effects image recording on a recording sheet by thermal transfer recording method. The structure of said unit will be explained in more detail later with reference to FIG. 3. An operation unit 103 is provided with various function keys such as a transmission start key, and input keys for telephone numbers. A switch **103*a*, used for indicating the kind of the ink sheet 14 to be employed, indicates a multi-print ink sheet or an ordinary one-time ink sheet respectively when it is on or off. A display unit 104, usually positioned next to the operation unit, indicates the state of various functions and the state of the apparatus. A power source unit 105 supplies the entire apparatus with electric power. There are further provided a modem (modulator-demodulator) for AC-DC conversion of the transmission or reception signal, a network control unit (NCU) 107 for communication control for an outside line, and a telephone set 108** with a telephone dial.

In the following there will be explained the structure of the recording unit 102 with reference to FIG. 3, wherein same components as those in FIG. 2 are represented by same numbers.

A rolled sheet 10, composed of plain recording paper 11 wound on a core **10*a*, is rotatably housed in the apparatus so as to feed the recording sheet 11 to a thermal head unit 13 by the rotation of a platen roller 12 in the direction of arrow. A rolled sheet loading unit 10*b* detachably houses the rolled sheet 10. The platen roller 12 advances the recording sheet 11 in a direction b, and presses an ink sheet 14 and the recording sheet 11 to the heat-generating elements 132 of the thermal head 13. After the image recording by the heat generated by the thermal head 13, the recording sheet 11 is advanced toward discharge rollers 16*a*, 16*b* by further rotation of the platen roller 12. Upon completion of image recording of a page, the recording sheet is cut into a page by the engagement of cutter members 15*a*, 15*b*** and is discharged.

An ink sheet feed roll 17 with wound ink sheet 14 and an ink sheet takeup roll 18 are driven by an ink sheet motor to be explained later, for advancing the ink sheet 14 in a direction a. Said ink sheet feed roll 17 and ink sheet takeup roll 18 are detachably loaded in an ink sheet loading unit 70 of the apparatus. There are further provided a sensor 19 for detecting the remaining amount and the transport speed of the ink sheet 14; an ink sheet sensor 20 for detecting the presence or absence of the ink sheet 14; a spring 21 for pressing the thermal head 13 to the platen roller 12 across the recording sheet 11 and the ink sheet 14; and a recording sheet sensor 22 for detecting the presence or absence of the recording sheet.

In the following there will be explained the structure of the reading unit 100.

A light source 30 illuminates an original image 32. The light reflected by said original image 32 is guided, through an optical system (mirrors 50, 51 and a lens 52), to the CCD sensor 31 and converted into an electrical signal. The original 32 is transported at a speed corresponding to the reading speed for said original, by means of transport rollers 53, 54, 55, 56 driven by an unrepresented original transporting motor. An original stacker 57 can support plural originals. Said originals are guided by a slider **57*a*, then separated one by one, by the cooperation of a transport roller 54 and a separating member 58, subjected to image reading in the reading unit 100 and discharged to a tray 77**.

There are also provided a control circuit board 41 constituting the principal part of the control unit 101 and sending control signals to the various units of the apparatus; a modem circuit board 106; and an NCU circuit board 107.

FIG. 4 shows the details of a transport mechanism for the ink sheet 14 and the recording sheet 11.

A recording sheet transport motor 24 rotates the platen roller 12, thereby advancing the recording sheet in a direction b which is opposite to the direction a. An ink sheet transport motor 25 advances the ink sheet 14 in said direction a by a capstan roller 71 and a pinch roller 72. There are also provided gears 26, 27 for transmitting the rotation of the recording sheet transport motor 24 to the platen roller 12; gears 73, 74 for transmitting the rotation of the ink sheet transport motor 25 to the capstan roller 71; and a slip clutch unit 75.

The ink sheet 14 transported by the capstan roller 71 can be securely taken up on the roll 18, by selecting the ratio of the gears 74 and 75 in such a manner that the length of the ink sheet 14 taken up on the roll 18 by the rotation of the gear 75*a* is longer than that of the ink sheet transported by the capstan roller 71. The difference between the amount of ink sheet 14 taken up by the roll 18 and that advanced by the capstan roller 71 is absorbed by the slip clutch unit 75, and the variation in the transport speed of the ink sheet 14, resulting from the change in the diameter of the roll 18, can be prevented.

FIG. 1 shows electrical connections between the control unit 101 and the recording unit 102 in the facsimile apparatus of the present embodiment, wherein same components as those in other drawings are represented by same numbers.

The thermal head 13 is composed of a line head, and is provided with a shift register 130 for storing serial recording data of a line and shift clock signals 43 supplied from the control unit 101, a latch circuit 131 for latching the data of the shift register 130 by a latch signal 44, and heat-generating elements 132 composed of plural heat-generating resistors of a line. Said heat-generating resistors 132 are driven in divided manner in m blocks 132-1–132-m. A temperature sensor 133 is mounted on the thermal head 13 for detecting the temperature thereof. The output signal 42 of said temperature sensor 133 is A/D converted in the control unit 101 and supplied to said CPU 113, which in response detects the temperature of the thermal head 13 and accordingly regulates the energy supplied to the thermal head 13 depending on the characteristics of the ink sheet 14, for example by varying the pulse duration of a strobe signal 47 or by varying the drive voltage for the thermal head 13. Programmable timers 116, 117 are set at times by the CPU 113, effect time measurement by instructions therefrom, and sends an interruption signal or a time-out signal to the CPU 113 at instructed times.

The kind of the ink sheet 14 may be identified by a manual operation of the switch 103*a* of the aforementioned operation unit 103, or automatically by a mark printed on the ink sheet 14 or a mark, a notch or a projection provided on the cartridge of said ink sheet.

A driving circuit 46 receives a drive signal for the thermal head 13 from the control unit 101, and generates a strobe signal 47 for driving each block of the thermal head 13. Said driving circuit 46 is capable, in response to a command of the control unit 101, of varying the energy supplied to the thermal head 13 by varying the voltage to a power supply line 45 for current supply to the heat-generating elements 132 of the thermal head 13. A driving circuit 36, for driving cutter members 15, contains a cutter driving motor etc. A sheet discharge motor 39 drives the discharge rollers 16. Driving circuits 35, 48, 49 respectively drive the discharge motor 39, the recording sheet motor 24 and the ink sheet motor 25. Said motors are composed of stepping motors in the present embodiment, but they may also be composed of DC motors.

[Recording operation (FIGS. 1–6)]

Figures 5, 5A:
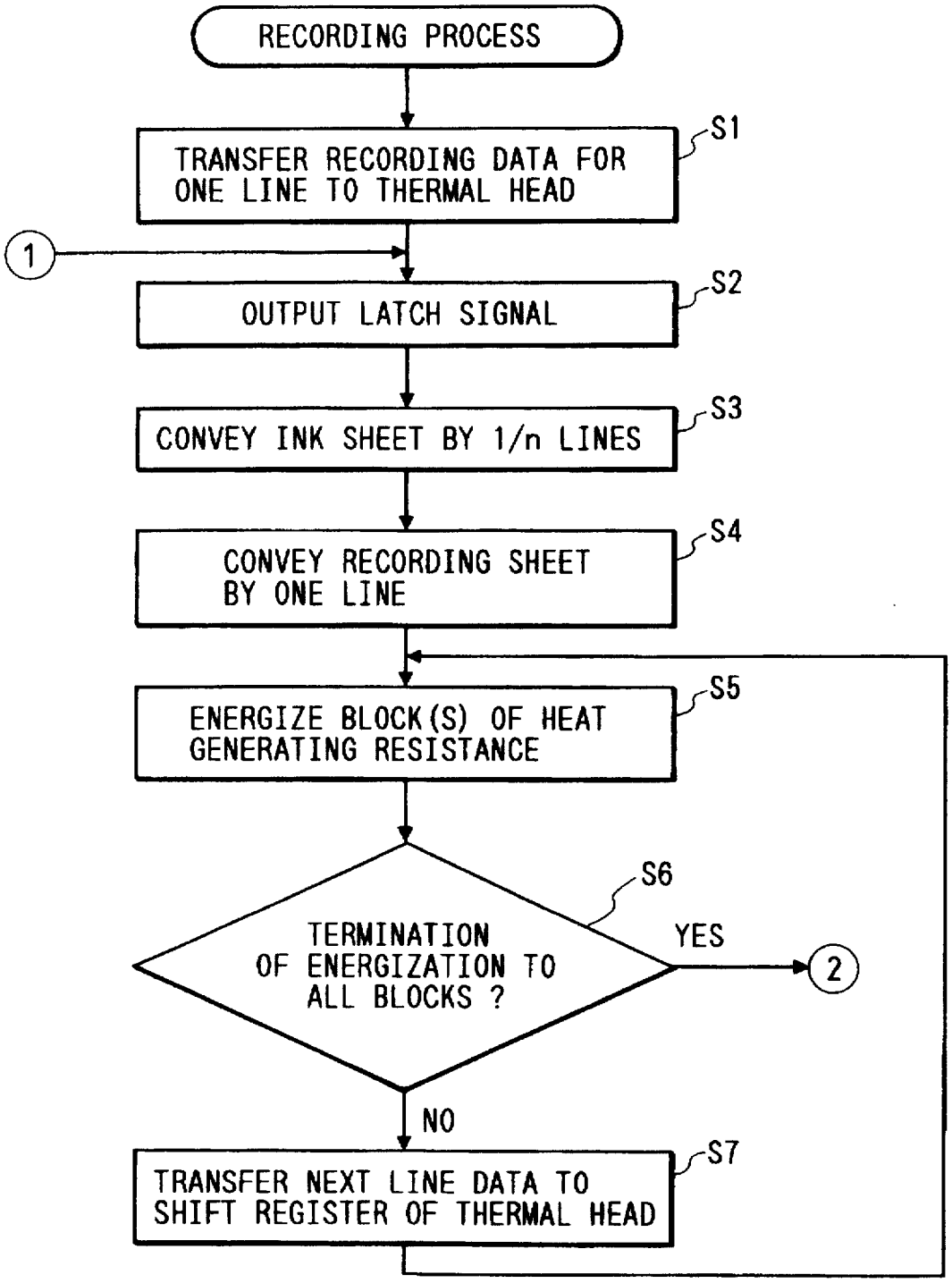
FIG. 5, including
FIG. 5A and 5B, is a flow chart of the recording sequence in the facsimile apparatus of said embodiment.
Figure 5B:
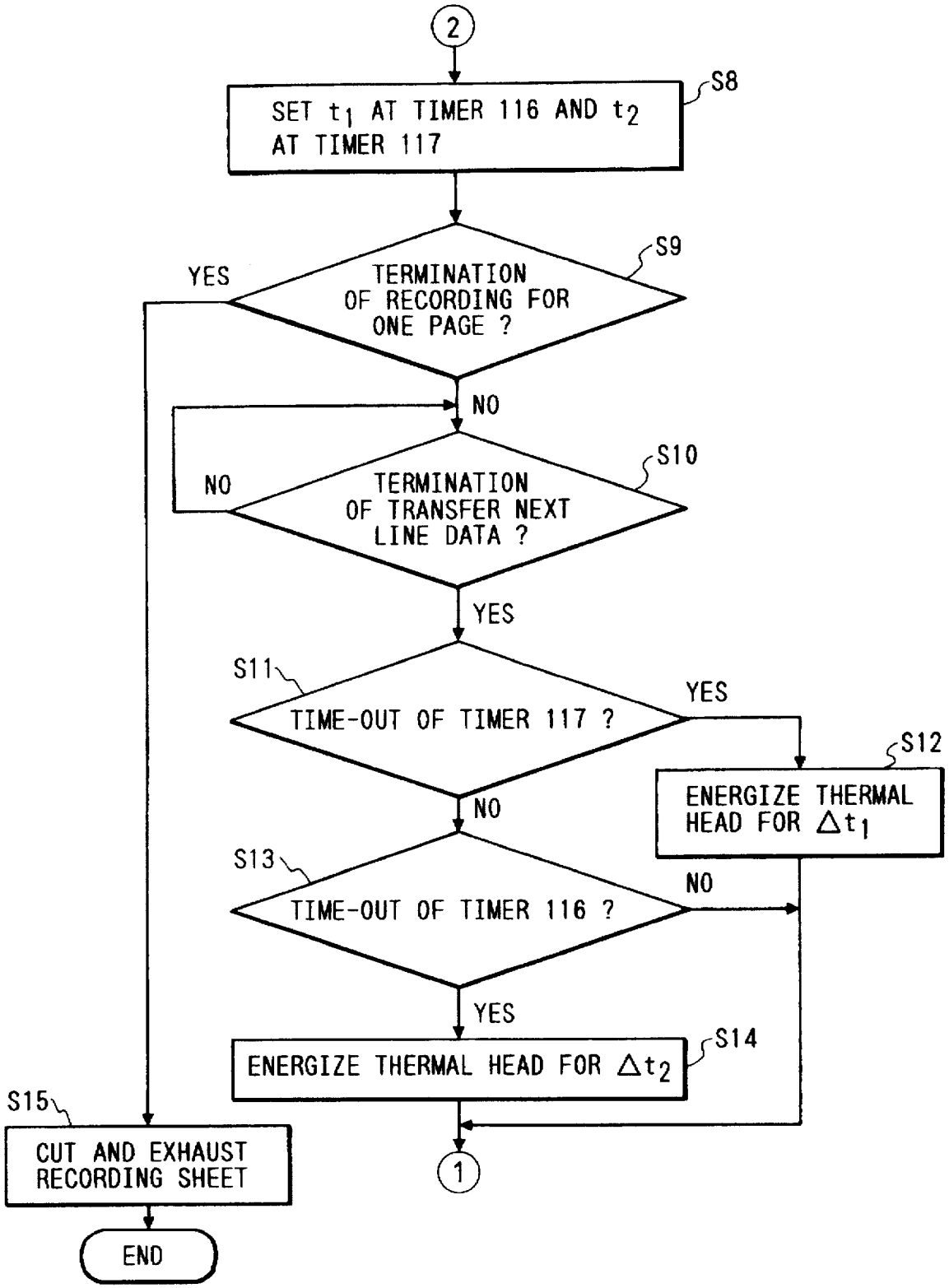

FIG. 5 is a flow chart of a page recording sequence in the facsimile apparatus of the present embodiment, and a corresponding program is stored in the ROM 114 of the control unit 101.

Said sequence is started when the image data of a line to be recorded are stored in the line memory 110 whereby the recording operation is enabled. It is assumed that the control unit 101 identifies the loading of a multi-print ink sheet 14 for example by the switch 103*a*.

At first a step S1 serially transfers the recording data of a line to the shift register 130. Upon completion of said data transfer, a step S2 generates the latch signal 44 to store the recording data of a line in the latch circuit 131. Then a step S3 activates the ink sheet motor 25 thereby transporting the ink sheet 14 by an amount of 1/n lines. A step S4 then transports the recording sheet 11 by an amount corresponding to a line. In the facsimile apparatus of the present embodiment, said length of a line is selected at ca. 1/15.4 mm, and the amounts of transportation of the recording sheet 11 and the ink sheet 14 are determined by varying the numbers of energizing pulses respectively for the recording sheet motor 24 and the ink sheet motor 25.

A next step S5 executes image recording by energizing each block of the heat-generating elements 132, and a step S6 discriminates whether all the m blocks have been energized. If not, the sequence proceeds to a step S7 for transferring the recording data of a next line to the shift register 130 of the thermal head 13, and then returns to the step S5.

If the step S6 identifies the completion of energization of all the m blocks, indicating the completion of recording of a line, a step S8 sets the timer 116 at a predetermined time $t_1$ (for example 20 ms), and the timer 117 at another predetermined time $t_2$ (for example 25 ms; $t_2>t_1$), and initiates the time measurement by said timers 116, 117. Then a step S9 discriminates whether the image recording of a page has been completed. If not, a step S10 discriminates whether all the image data of a next line have been transferred to the shift register 130 of the thermal head 13. If not, the step S10 awaits the transfer of all the data of the next line to the thermal head 13. On the other hand, if the step S9 identifies the completion of image recording of a page, the sequence proceeds to a step S15 for effecting the cutting and discharge of the recording sheet 11, thereby terminating the image recording sequence.

Upon completion of the transfer of the image data of a line to be recorded next to the thermal head 13, the sequence proceeds to a step S11 for discriminating whether the timer 117 has expired, namely whether 25 ms has elapsed. If not, the sequence proceeds to a step S13 for discriminating whether the timer 116 has expired, namely whether 20 ms has elaspsed. If not (namely if 20 ms has not elapsed after the recording of the preceding line), the sequence returns to the step S2 for repeating the recording sequence explained above.

If the step S13 identifies that the timer 116 has expired (elapsed time between 20 and 25 ms), the sequence proceeds to a step S14 for energizing the thermal head 13 for a period $\Delta t_2$ and then returns to the step S2. On the other hand, if the step S11 identifies that the timer 117 has expired (elapsed time at least equal to 25 ms), the sequence proceeds to a step S12 for energizing the thermal head 13 for a period $\Delta t_1$ and then returns to the step S2. Said periods $\Delta t_1$ and $\Delta t_2$ satisfy a relation $\Delta t_1>\Delta t_2$. In the present embodiment, $\Delta t_1$ and $\Delta t_2$ are respectively selected, for example, at 0.1 ms and 0.05 ms. Consequently the energy supplied to the thermal head 13 in the step S12 is larger than that in the step S14.

As explained in the foregoing, in the present embodiment, the thermal head 13 is given a larger energy, if the period from the completion of the preceding recording operation to the start of next recording operation is longer, whereby the cooled thermal head 13 is sufficiently heated and the adhesion of the ink sheet 14 and the recording sheet 11 is reduced.

Figure 6:
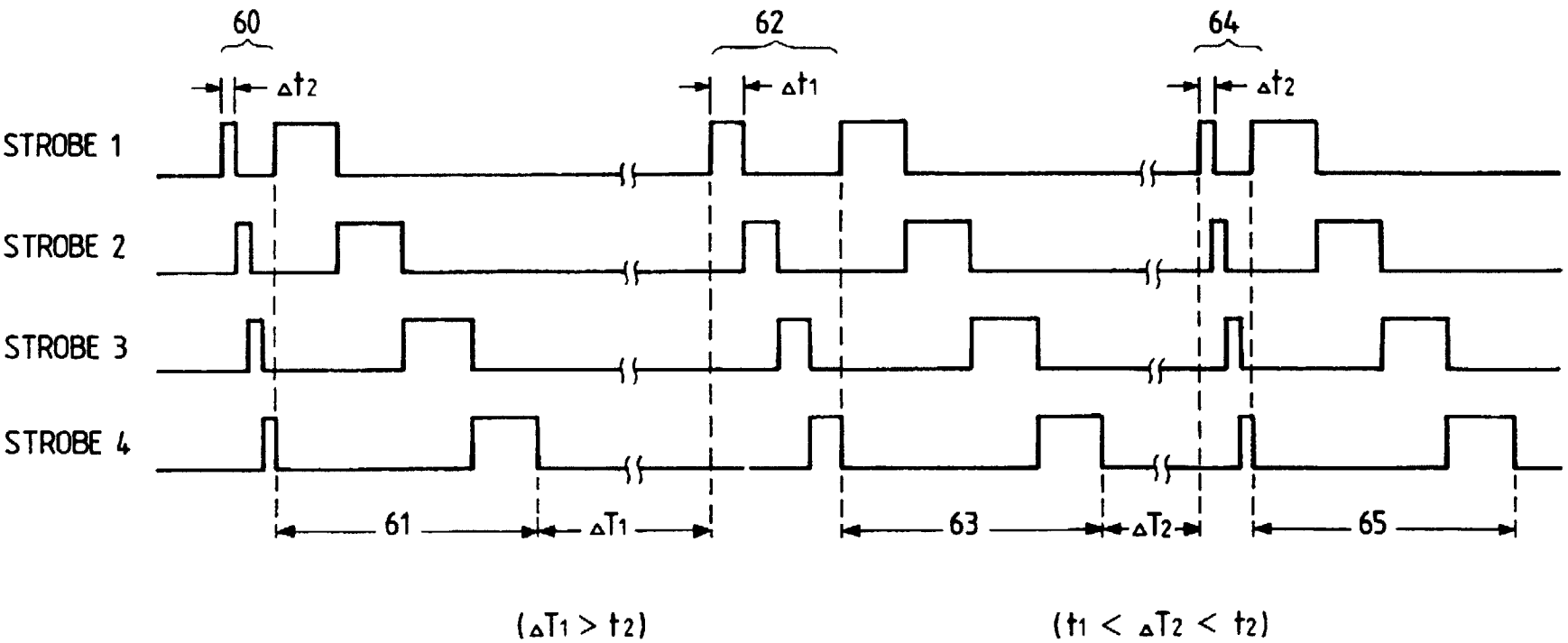
FIG. 6 is a timing chart showing the timing of energization of recording in said embodiment.

FIG. 6 shows an example of timing of energization of the thermal head 13 in the recording operation in this embodiment. In this example, the heat-generating resistors 132 of the thermal head 13 are energized in four blocks. Strobe signals 1–4 respectively correspond to said blocks of the heat-generating resistors 132.

In FIG. 6, 61, 63 and 65 indicate the timings of energization in the actual image recording, while 60 and 64 indicate the timings of energization of a period $\Delta t_2$ conducted in the step S14 shown in FIG. 5. Also 62 indicates the timing of energization of a period $\Delta t_1$ conducted in the step S12 shown in FIG. 5. A time $\Delta T_1$, indicating the period from the end of the recording operation 61 to the transfer of the recording data for the recording operation 63 to the thermal head 13, is longer in this case than the time $t_2$ set in the timer 117.

Also the period $\Delta T_2$, from the end of the recording operation 63 to the transfer of the recording data for the next recording operation 65 to the thermal head 13, is longer than the time $t_1$ set in the timer 116 but shorter than the time $t_2$ set in the timer 117. Consequently, the energization 62 of the thermal head 13 after the period $\Delta T_1$ following the image recording 61 is conducted with a pulse duration $\Delta t_1$, while the energization 64 after the period $\Delta T_2$ following the image recording 63 is conducted with a pulse duration $\Delta t_2$. The present embodiment employs a control of two levels, but there may also be employed a control or three or more levels. Also at such preheating of the recording head, the recording data used for such pre-heating may be those completely different from the recording data of the new line, such as all black data that activate all the heat-generating elements of the thermal head.

[Another embodiment]

In the following there will be explained another embodiment employing plural pre-heatings, in which the duration of the pulse supplied to the thermal head 13 is varied depending not only on the interval of recordings but also on the temperature of the thermal head. In the following, same components as those in the foregoing embodiment will be represented by same numbers and will not be explained further.

Figure 7:
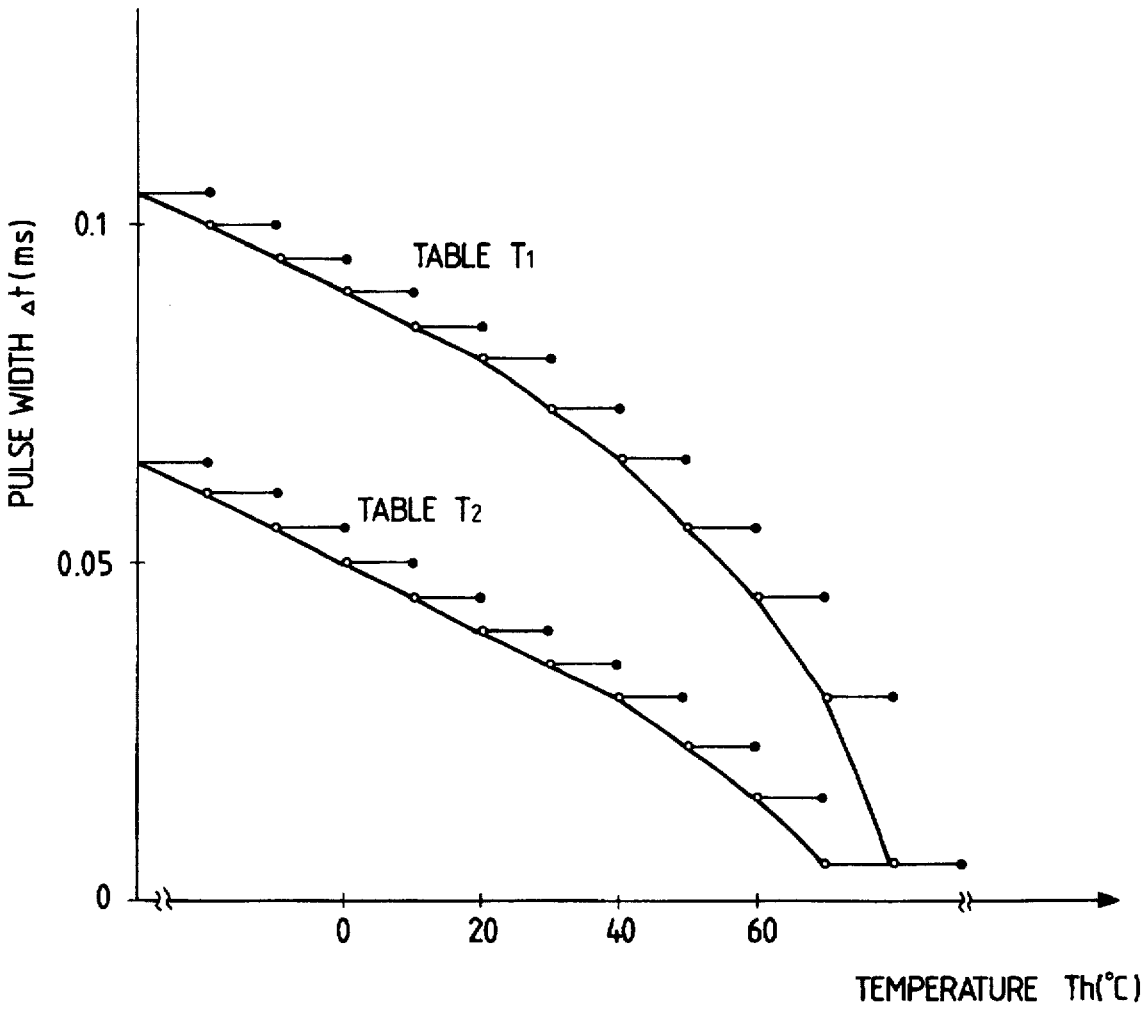
FIG. 7 is a chart showing the relation between the pulse duration and the temperature in another embodiment of the present invention.

FIG. 7 shows the relation between the temperature Th of the thermal head 13 and the duration $\Delta t$ of the energizing pulse.

The temperature of the thermal head 13 is detected from the output signal of the temperature sensor 133. In the present embodiment there are provided two tables T1, T2 which are respectively selected when the interval of recording is at least equal to 20 msec or less than 20 msec.

Data of said tables T1, T2 are so constructed that the duration of the energizing pulse becomes shorter with the increase of the temperature of the thermal head 13. For a same head temperature, the table T1 provides a longer pulse duration than in the table T2. Consequently the energy supplied to the thermal head 13 increases as the temperature of the thermal head 13 is lower or as the interval of recording is longer in excess of 20 msec.

The present embodiment employs two tables as explained above, but there may naturally be employed three or more tables.

Figures 8, 8A:
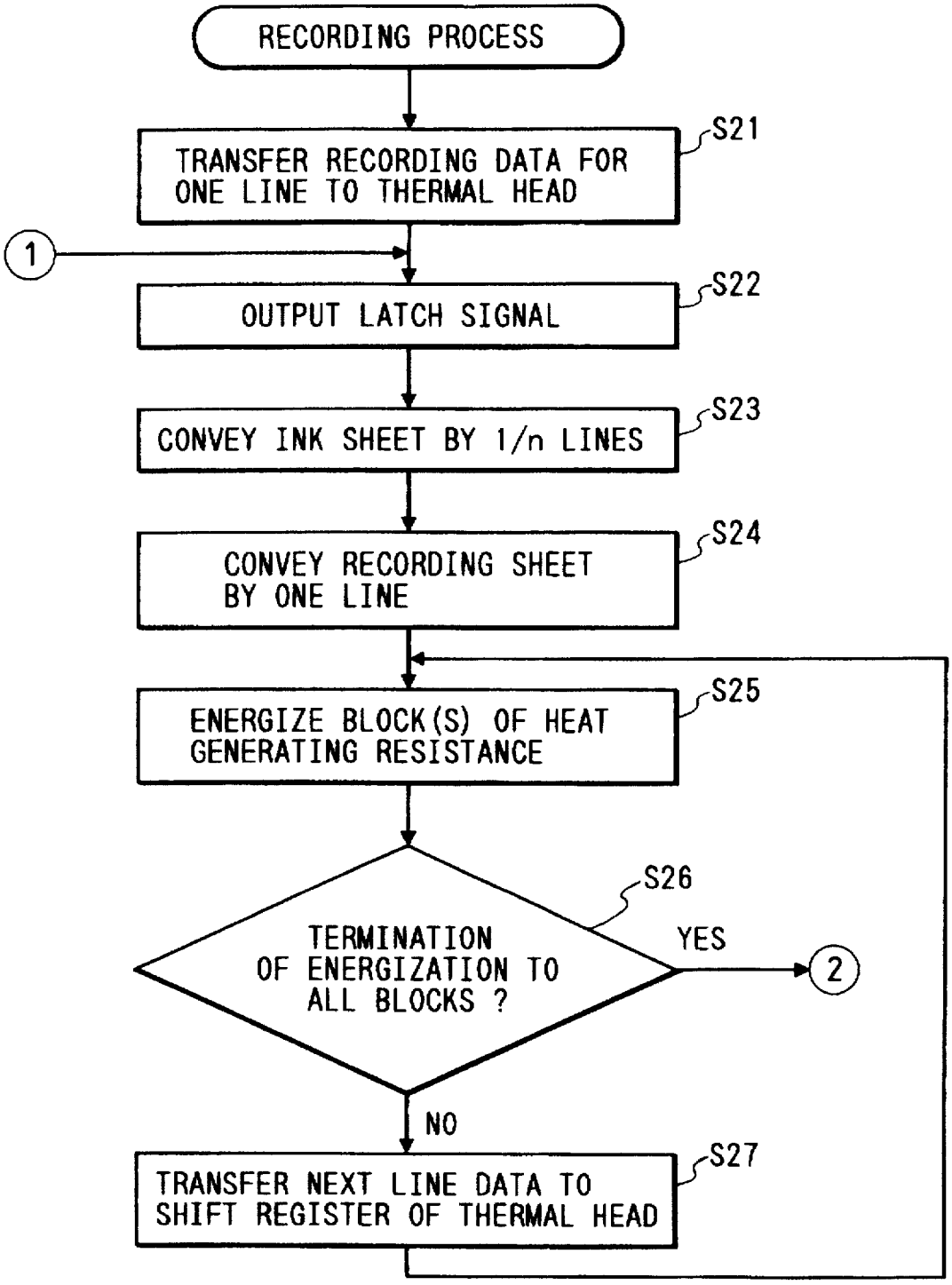
FIG. 8, including
FIG. 8A and 8B, is a flow chart of the recording sequence in a facsimile apparatus of said another embodiment of the present invention.
Figure 8B:
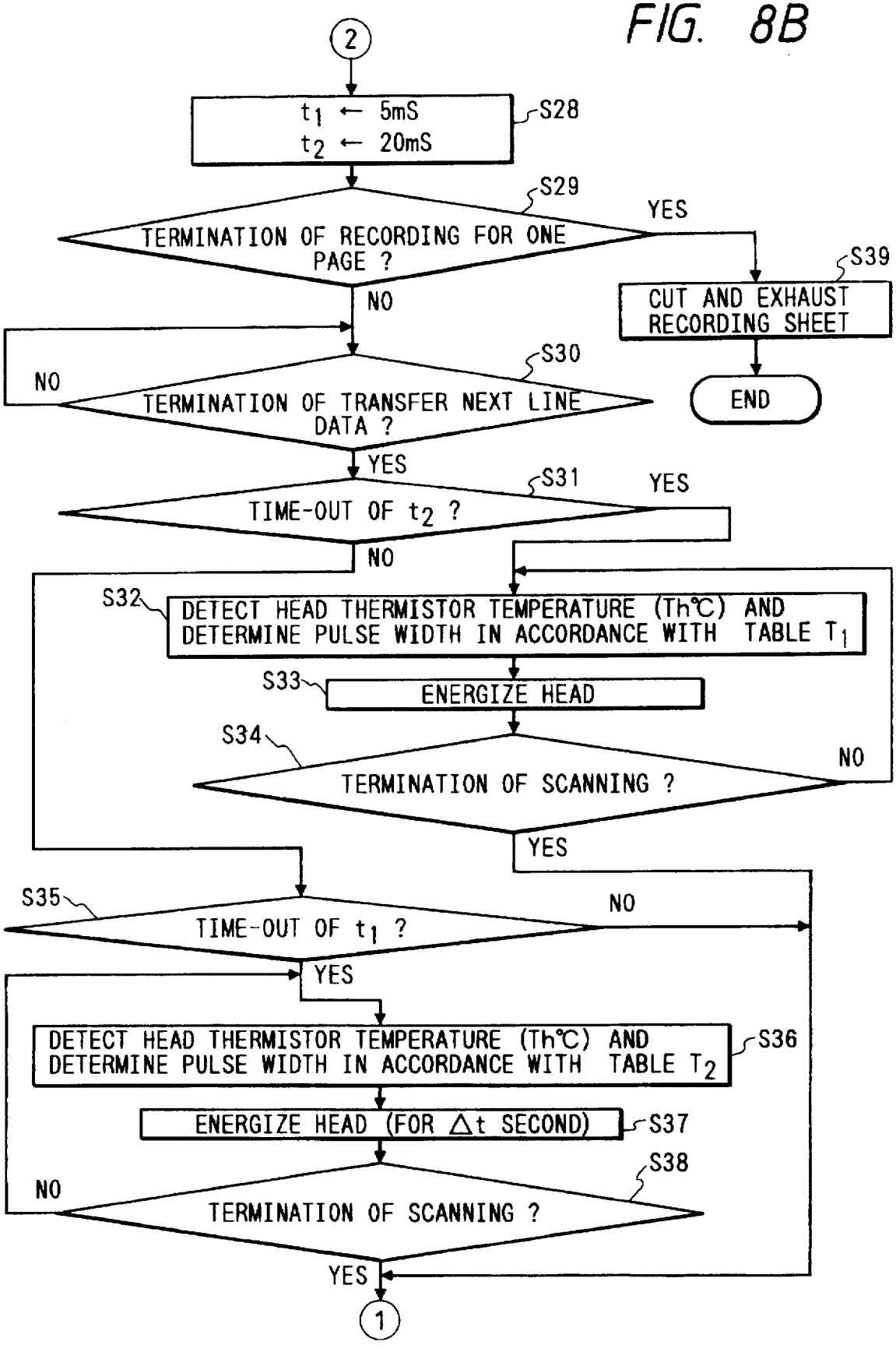

FIG. 8 is a flow chart of the recording sequence of a page in the facsimile apparatus of the present embodiment, and a corresponding control program is stored in the ROM 114 of the control unit 101.

This sequence is started when the image data of a line to be recorded are stored in the line memory 110 whereby the recording operation is enabled. It is assumed that the control unit 101 identifies the loading of a multi-print ink sheet 14 for example by the switch 103*a* of the operation unit 103.

At first a step S21 transfers the recording data of a line serially to the shift register 130. Upon completion of said data transfer, a step S22 generates the latch signal 44 to store the recording data of a line in the latch circuit 131. Then a step S23 activates the ink sheet motor 25 thereby transporting the ink sheet 14 by an amount of 1/n lines. In the facsimile apparatus of the present embodiment, said length corresponding to a line is selected as ca. 1/15.4 mm, and the amounts of transportation of the recording sheet 11 and the ink sheet 14 are determined by varying the number of energizing pulses respectively for the recording sheet motor 24 and the ink sheet motor 25.

A next step S25 executes image recording by energizing one of the blocks of the heat-generating elements 132, and a step S26 discriminates whether all the m blocks have been energized. If not, the sequence proceeds to a step S27 for transferring the recording data of a next line to the shift register 130 of the thermal head 13, and then returns to the step S25.

If the step S26 identifies the completion of energization of all the m blocks, indicating the completion of recording of a line, a step S28 sets the timer 116 at a predetermined time $t_1$ (for example 5 msec) and the timer 117 at another predetermined time $t_2$ (for example 20 msec), and initiates the time measurement by said timers 116, 117. Then a step S29 discriminates whether the image recording of a page has been completed. If not, a step S30 discriminates whether all the image data of a next line have been transferred to the shift register 130 of the thermal head 13. If not, the step S30 awaits the transfer of all the data of the next line to the thermal head 13.

Upon completion of the transfer of the image data of a line to be recorded next to the thermal head 13, the sequence proceeds to a step S31 for discriminating whether the timer 117 has expired, namely whether the time $t_2$ (20 ms in this case) has elapsed. If elapsed, the sequence proceeds to a step S32 for detecting the temperature Th of the thermal head 13 from the output signal 42 of the temperature sensor 133, and determining the pulse duration $\Delta t$ for preheating the thermal head 13, based on the table T1 shown in FIG. 7. Then a step S33 executes pre-heating by energizing all the blocks of the thermal head 13 for a period $\Delta t$. Then a step S34 discriminates whether said pre-heating is of the 2nd time.

If it is the pre-heating of the 1st time, the sequence returns to the step S32 to detect the temperature of the thermal head 13 by the temperature sensor 133, and the steps S32 to S34 execute again the pre-heating according to the temperature of the thermal head 13.

The present embodiment executes the pre-heating in two cycles as explained above, but there may be employed a larger number of cycles. When the step S34 confirms the completion of pre-heating of two cycles, the sequence returns to the step S22 for executing the image recording as explained before.

If the step S31 identifies that the time $t_2$ has not elapsed, the sequence proceeds to a step S35 for discriminating whether the timer 116 has expired, namely whether the time $t_1$ (5 msec in this case) has elapsed. If elapsed, a step S36 detects the temperature Th of the thermal head 13 from the output signal 42 of the temperature sensor 133 and determines the duration $\Delta t$ of the pulse energizing the thermal head 13, based on the table T2 shown in FIG. 7.

Then a step S37 energizes the thermal head 13 for a period $\Delta t$. Then, if a step S38 identifies the pre-heating as of the 1st cycle, the sequence returns to the step S36 for detecting the temperature of the thermal head 13 from the signal of the temperature sensor 133, and a pre-heating based on said temperature is conducted in the same manner as in the steps S36 and S37 explained before. On the other hand, if the pre-heating of the 2nd cycle is identified, the sequence returns to the step S22 for executing the image recording as explained before.

If the step S35 identifies that the time $t_1$ has not elapsed, namely 5 msec has not elapsed after the recording of the preceding line, the sequence returns to the step S22 for effecting the recording of the next line.

When the step S29 identifies the completion of recording of a page, the sequence proceeds to a step S39 for cutting and discharging the recording sheet 11, thereby terminating the image recording sequence.

In the present embodiment, as explained in the foregoing, the thermal head 13 is given a larger energy when the interval from the end of the preceding recording operation to the start of the next recording operation is long, or when the temperature of the thermal head 13 is lowered, whereby the cooled thermal head 13 can be sufficiently warmed and the adhesion between the ink sheet 14 and the recording sheet 11 can be reduced.

Figure 9:
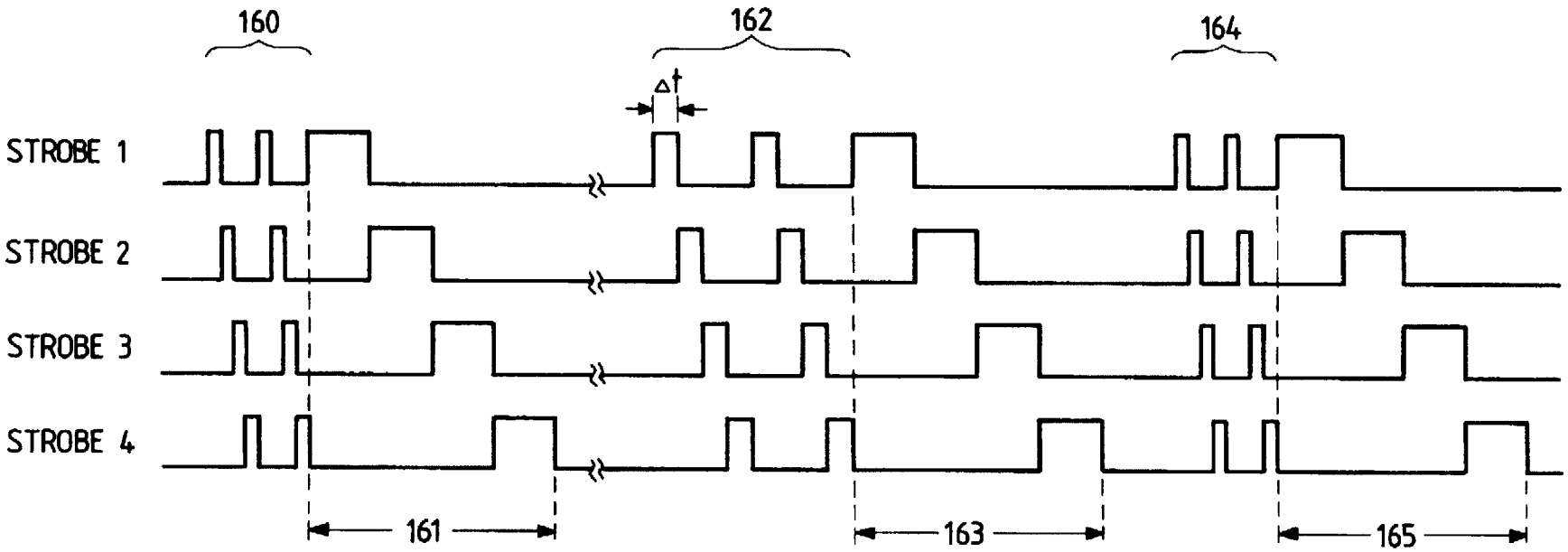
FIG. 9 is a timing chart showing the timing of energization of recording in said another embodiment of the present invention.

FIG. 9 shows an example of the timing of energization of the thermal head 13 in the recording operation of the present embodiment.

As explained in the foregoing, the heat-generating resistors 132 of the thermal head 13 are driven in four divided blocks. Strobe signals 1–4 respectively correspond to the blocks of said heat-generating resistors 132.

Referring to FIG. 9, 161, 163 and 165 indicate the timing of energization in the actual image recording, while 160, 162, 164 indicate the timing of two-step pre-heating executed in the steps S33 and S37 shown in FIG. 8. ΔT indicates the pulse duration at the pre-heating, determined by the temperature Th of the thermal head 13 and the interval of recording, according to the table T1 or T2 shown in FIG. 7.

In the above-explained embodiment, the pre-heatings of two cycles are conducted with the recording data of the preceding line, but said data used for heating the heat-generating elements in such pre-heating operation may be completely different from those of the preceding line, and can for example be all black data for activating all the heat-generating elements of the thermal head.

Also in the foregoing embodiment, the pre-heating of the recording means conducted between the recording operations or before the next recording operation is conducted with a small energy which is not enough for recording an image on the recording medium.

[Principle of recording (FIG. 10)]

Figure 10:
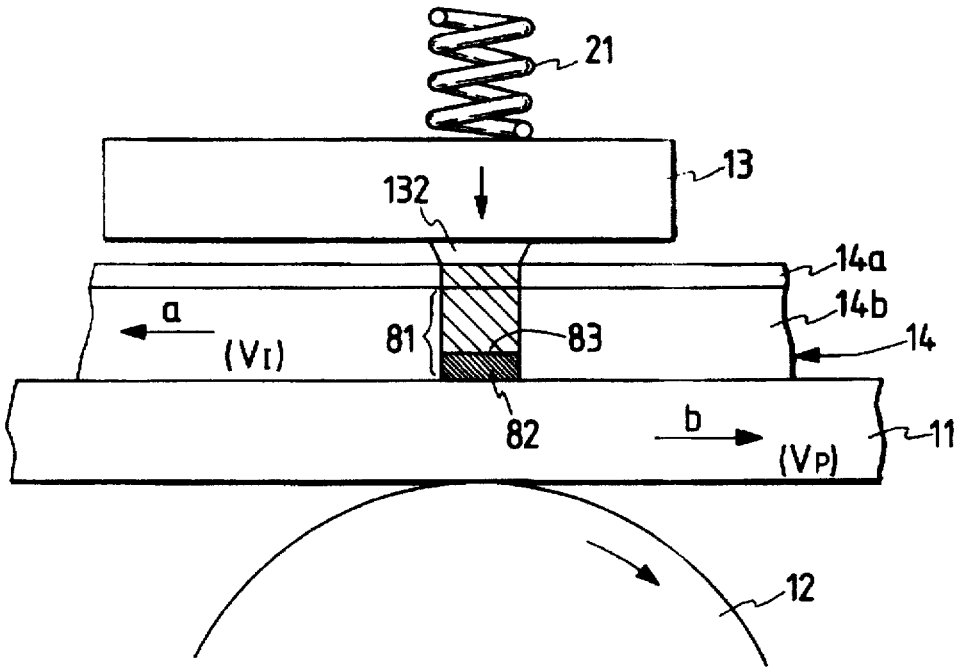
FIG. 10 is a cross-sectional view showing the principle of recording in said embodiment.

FIG. 10 shows the state of image recording in the present embodiment in which the recording sheet 11 and the ink sheet 14 are moved in mutually opposite directions.

As shown in FIG. 10, the recording sheet 11 and the ink sheet 14 are pinched between the platen roller 12 and the thermal head 13, which is pressed against the platen roller 12 at a predetermined pressure exerted by the spring 21. The recording sheet is transported in a direction b with a speed $V_P$ by the rotation of the platen roller 12. On the other hand, the ink sheet 14 is advanced in a direction a with a speed $V_I$ by the rotation of the ink sheet motor 25.

When the heat-generating elements 132 of the thermal head 13 are energized by the power source unit 105, a hatched area 91 of the ink sheet 14 is heated. **14*a* indicates the substrate film of the ink sheet, while 14*b* indicates the ink layer thereof. Energization of the heat-generating elements 132 fuse the ink of the ink layer 91, and part 92 thereof is transferred to the recording sheet 11. The transferred part 92 is about 1/n of the ink layer 91**.

At said transfer, it is necessary to generate a shearing force at a boundary line 93 of the ink layer **14*b*, thereby transferring the ink layer portion 92 only onto the recording sheet 11. However this shearing force varies depending on the temperature of the ink layer, and tends to become smaller as the temperature of the ink layer is higher. As the shearing force in the ink layer becomes larger with a shorter heating time of the ink sheet 14, the ink layer to be transferred can be securely peeled from the ink sheet 14 by an increase in the relative speed between the ink sheet 14 and the recording sheet 11**.

In the present embodiment, the relative speed between the ink sheet 14 and the recording sheet 11 is increased by adopting mutually opposite transport directions for said sheets, as the heating time of the thermal head 13 in a facsimile apparatus is as short as about 0.6 seconds.

[Ink sheet (FIG. 11)]

Figure 11:
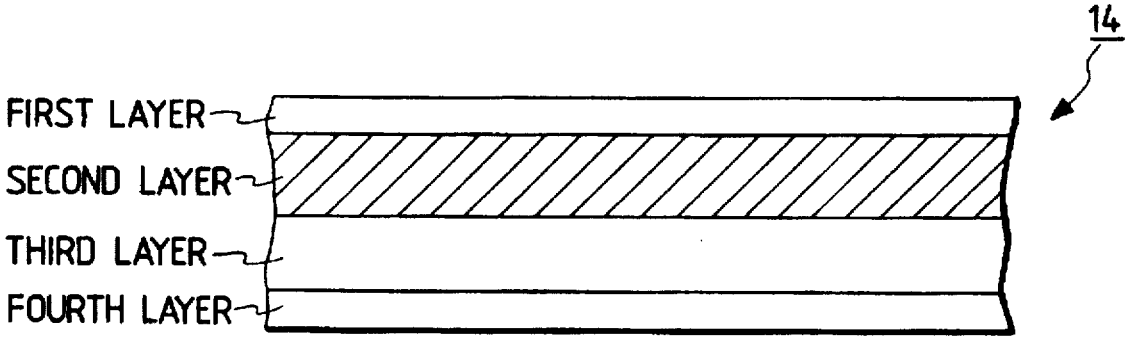
FIG. 11 is a cross-sectional view of a multi-printing ink sheet employed in said embodiment.

FIG. 11 is a cross-sectional view of the multi-print ink sheet employed in the present embodiment and composed in this case of four layers.

A second layer is composed of a substrate film for the ink sheet 14. In case of multi-printing, as a same position is subjected to thermal energy plural times, there is advantageously employed aromatic polyamide film or condenser paper which has a high thermal resistance, but conventional polyester film may also be employed for this purpose. The thickness of said substrate film is preferably as small as possible for improving the print quality, but is desirably in a range of 3 to 8 μm in consideration of the mechanical strength.

A third layer is an ink layer containing an amount of ink allowing transfers of n times onto the recording sheet. Said ink layer is principally composed of an adhesive material such as EVA resin, a coloring material such as carbon black or nigrosin dye, and a binding material such as carnauba wax or paraffin wax, so as to enable uses of n times in a same place. the coating amount of said ink is preferably in a range of 4–8 g/m$^2$, but can be arbitrarily selected as the sensitivity or density can be regulated by said coating amount.

A 4th layer is a top coating layer composed for example of transparent wax, for preventing the transfer of the ink of the 3rd layer by pressure to the recording sheet in non-printing portions. The transfer by pressure takes therefore place in the transparent 4th layer only, and the background smudge can thus be prevented. A first layer is a thermally resistant coating, for protecting the substrate film of the 2nd layer from the heat of the thermal head 13. Presence of such coating is preferable for multi-printing in which thermal printing of n lines may be applied to a same position (when black information continues), but the use of such coating may be arbitrarily selected. Also such coating is effective for a substrate film of relatively low heat resistance, such as a polyester film.

The structure of the ink sheet 14 is not limited to this embodiment, but may be composed for example of a substrate layer and a porous ink containing layer provided on a side of said substrate layer, or of a heat resistant ink layer of a fine porous network structure formed on a substrate film and impregnated with ink. The substrate film can be composed of a film for example of polyamide, polyethylene, polyester, polyvinyl chloride, triacetyl cellulose or nylon, or paper. The heat resistant coating, which is not indispensable, may be composed of silicone resin, epoxy resin, fluorinated resin or nitrocellulose.

As an example, the ink sheet having thermosublimable ink can be composed of a substrate material composed of polyethylene terephthalate, polyethylene naphthalate or aromatic polyamide, and a coloring material layer formed thereon and containing a dye and spacer particles formed from guanamine resin and fluorinated resin.

Also the heating method is not limited to the aforementioned method utilizing a thermal head, but may also be a method of supplying an electric current into the ink layer or a method of ink transfer with a laser beam.

Though the foregoing embodiments have been limited to a structure employing a thermal line head, the present invention is also applicable to so-called serial type thermal transfer printer. Also the foregoing embodiment have been limited to the case of multi-printing, but the present invention is likewise applicable to ordinary thermal transfer recording employing the one-time ink sheet.

Furthermore, though the foregoing embodiments have been limited to the thermal transfer printer applied to a facsimile apparatus, the present invention is applicable also to a word processor, a typewriter, a copying apparatus of the like.

The recording medium is not limited to recording paper but can also be composed of cloth or plastic sheet, for example, as long as ink transfer is possible. Also the ink sheet is not limited to the rolled structure shown in the foregoing embodiments but can also be of so-called ink sheet cassette structure in which a casing holding ink sheets therein, is detachably loaded in teh recording apparatus.

In the present embodiment, as explained in the foregoing, the recording head is activated again with the image data of the preceding line if the interval between the recording operations exceeds a predetermined time. Also a larger energy than in the preceding recording operation is applied to the recording head if a time longer than said predetermined time has elapsed, whereby the separation of the ink sheet and the recording sheet can be facilitated and a sufficiently high image density can be obtained.

The foregoing embodiments employ a thermal head as the recording means, but the present invention is not limited to such recording means. For example, there may be employed an ink jet recording head, for recording an image on the recording medium by discharging ink. Such ink jet recording head is generally equipped with a fine liquid discharge opening (orifice), a liquid path, an energy action part provided on a part of said liquid path, and energy generating means for generating a liquid droplet forming energy to act on the liquid present in said energy action part. Said energy generating means may be composed of an electromechanical converter such as a piezoelectric element, means for irradiating with an electromagnetic wave such as a laser beam thereby heating said liquid and generating a liquid droplet by the effect of said heat, or an electrothermal converter for heating the liquid thereby discharging said liquid. Among these methods, so-called bubble ink jet recording head, in which the electrothermal converter is given a drive signal causing a rapid temperature increase in said converter causing membrane boiling on said converter and forming a bubble in the ink liquid, thereby discharging ink from the discharge opening by the growth of said bubble, is particularly suitable for recording of high resolving power because the discharge openings can be arranged with a high density.

These embodiments are particularly effective in the facsimile apparatus or the like in which the interval of the image data of the lines is not constant and may become long.

As explained in the foregoing, the recording means is activated before the next recording operation if the recording operation is interrupted over a predetermined period after the preceding recording of a line, and said recording means is given an increased energy if the recording operation is interrupted for a time longer than said predetermined period, whereby the quality of the recorded image can be improved and the separation of the ink sheet and the recording medium can be facilitated.

As explained in the foregoing, the present invention facilitates the separation of the ink sheet and the recording medium, and ensures satisfactory transportation of the recording medium.

What is claimed is:

1. A thermal transfer recording apparatus for recording data on a recording medium by transferring ink of an ink sheet on the recording medium, said apparatus comprising:

ink sheet conveying means for conveying the ink sheet;

recording medium conveying means for conveying the recording medium;

recording means having a plurality of heat generating elements for applying heat to the ink sheet;

driving means for driving each of said heat generating elements of said recording means by applying a pulse signal in accordance with transferred recording data so as to record an image on the recording medium;

timer means for commencing a time counting operation in response to a termination of recording of recording data and terminating the time counting operation in response to a termination of preparing next recording data;

first control means for controlling said driving means to drive said heat generating elements of said recording means with a pulse signal having a pulse width which is not sufficient to record before recording by the next recording data after termination of preparing the next recording data, said first control means changing the pulse width in accordance with a time counted by said timer means and the pulse width being greater when the time is longer than a predetermined time than when the time is shorter than the predetermined time; and second control means for controlling said ink sheet conveying means to convey the ink sheet after driving said heat generating elements by said first control means, wherein said driving means drives said heat generating elements in response to the next recording data after conveyance of the ink sheet by the second control means.

2. A thermal transfer recording apparatus for recording data on a recording medium by transferring ink of an ink sheet on the recording medium, said apparatus comprising:

ink sheet conveying means for conveying the ink sheet;

recording medium conveying means for conveying the recording medium;

recording means having a plurality of heat generating elements for applying heat to the ink sheet;

driving means for driving each of the plurality of heat generating elements of said recording means by applying a pulse signal in accordance with transferred recording data so as to record an image on the recording medium;

timer means for commencing a time counting operation in response to a termination of recording of recording data and terminating the time counting operation in response to a termination of preparing next recording data;

temperature detecting means for detecting a temperature relative to said recording means;

first control means for controlling said driving means to drive the heat generating elements of said recording means with a pulse signal having a pulse width which is not sufficient to record before recording by the next recording data after termination of preparing the next recording data, said first control means changing the pulse signal in accordance with a time counted by said timer means and the temperature detected by said temperature detecting means, the pulse width being greater when the time is longer than a predetermined time than when the time is shorter than the predetermined time; and second control means for controlling said ink sheet conveying means to convey the ink sheet after driving said heat generating elements by said first control means, wherein said driving means drives said heat generating elements in response to the next recording data after conveyance of the ink sheet by said second control means.

3. A thermal transfer recording apparatus according to claim 1 or 2, wherein said control means drives the heat generating elements of said recording means with a pulse signal having a pulse width not sufficient to record in accordance with the recording data used at an immediately previous image recording.

4. A thermal transfer recording apparatus according to claim 1 or 2, wherein control means drives the heat generating elements of said recording means with a pulse signal having a pulse width not sufficient to record in accordance with all black data.

5. A thermal transfer recording apparatus according to claim 1 or 2, wherein said control means drives the heat generating elements of said recording means for plural times with a pulse signal having a pulse width not sufficient to record.

6. A thermal transfer recording apparatus according to claim 1 or 2, wherein the ink sheet comprises a multi-coated layer.

7. A thermal transfer recording method for recording data on a recording medium by transferring ink of an ink sheet on the recording medium, said method comprising:

a first recording step for recording an image on the recording medium by a recording means having a plurality of heat generating elements for applying heat to the ink sheet in accordance with recording data;

a time counting step for commencing a time counting operation in response to a termination of recording of recording data and terminating the time counting operation in response to a termination of preparing next recording data;

a preheat step for driving each of the heat generating elements of the recording means in accordance with a time counted in said time counting step with a pulse signal having a pulse width which is not sufficient to record before recording by the next recording data after termination of preparing the next recording data, the pulse width being greater when the time is longer than a predetermined time than when the time is shorter than the predetermined time;

a moving step for moving the ink sheet relative to said recording means after driving said heat generating elements in said preheat step; and a second recording step for driving the plurality of heat generating elements by applying a pulse signal in accordance with the recording data after driving the heat generating elements in said preheat step so as to apply heat to the ink sheet to record an image on the recording medium.

8. A thermal transfer recording method for recording data on a recording medium by transferring ink of an ink sheet on the recording medium, said method comprising:

a first recording step for recording an image on the recording medium by a recording means having a plurality of heat generating elements for applying heat to the ink sheet in accordance with recording data;

a time counting step for commencing a time counting operation in response to a termination of recording of recording data and terminating the time counting operation in response to a termination of preparing next recording data;

a preheat step for driving each of the heat generating elements of the recording means in accordance with a time counted in said time counting step and a temperature relative to the recording means with a pulse signal having a pulse width which is not sufficient to record before recording by the next recording data after termination of preparing the next recording data, the pulse width being greater when the time is longer than a predetermined time than when the time is shorter than the predetermined time;

a moving step for moving the ink sheet relative to said recording means after driving said heat generating elements in said preheat step; and a second recording step for driving the heat generating elements by applying a pulse signal in accordance with the recording data after driving said heat generating elements in said preheat step so as to apply heat to the ink sheet to record an image on the recording medium.

9. A thermal transfer recording method according to claim 7 or 8, wherein in said preheat step the heat generating elements of the recording means are driven with a pulse signal having a pulse width not sufficient to record in accordance with the recording data used at an immediately previous image recording.

10. A thermal transfer recording method according to claim 7 or 8, wherein in said preheat step the heat generating elements of the recording means are driven with a pulse signal having a pulse width not sufficient to record in accordance with all black data.

11. A thermal transfer recording method according to claim 7 or 8, wherein in said preheat step the heat generating elements of the recording means are driven for plural times with a pulse signal having a pulse width not sufficient to record.

12. A thermal transfer recording method according to claims 7 or 8, wherein the ink sheet comprises a multi-coated layer.

13. An ink jet recording apparatus for recording on a recording medium by discharging an ink, said apparatus comprising:

recording means having a plurality of heat generating elements for applying heat to the ink;

driving means for driving each of the plurality of heat generating elements of said recording means by applying a pulse signal in accordance with transferred recording data so as to record an image on the recording medium;

timer means for commencing a time counting operation in response to a termination of recording of recording data and terminating the time counting operation in response to a termination of preparing next recording data; and control means for controlling said driving means to drive the heat generating elements of said recording means with a pulse signal having a pulse width which is not sufficient to record before recording by the next recording data after the termination of preparing the next recording data, wherein said control means changes the pulse width in accordance with a time counted by said timer means and the pulse width is greater when the time is longer than a predetermined time than when the time is shorter than the predetermined time.

14. An ink jet recording apparatus for recording on a recording medium by discharging an ink, said apparatus comprising:

recording means having a plurality of heat generating elements for applying heat to the ink;

driving means for driving each of the plurality of heat generating elements of said recording means by applying a pulse signal in accordance with transferred recording data so as to record an image on the recording medium;

timer means for commencing a time counting operation in response to a termination of recording of recording data and terminating the time counting operation in response to a termination of preparing next recording data;

temperature detecting means for detecting a temperature relative to said recording means; and control means for controlling said driving means to drive the heat generating elements of said recording means with a pulse signal having a pulse width which is not sufficient to record before recording by the next recording data after the termination of preparing the next recording data, wherein said control means changes the pulse width in accordance with a time counted by said timer means and the temperature detected by said temperature detecting means, and the pulse width is greater when the time is longer than a predetermined time than when the time is shorter than the predetermined time.

* * * * *

UNITED STATES PATENT AND TRADEMARK OFFICE

CERTIFICATE OF CORRECTION

PATENT NO. : 5,696,547

DATED : December 9, 1997

INVENTOR(S): TOMOYUKI TAKEDA ET AL.

It is certified that error appears in the above-identified patent and that said Letters Patent is hereby corrected as shown below:

ON THE TITLE PAGE AT [54], IN THE TITLE and Column 1,
"AUXILLIARY" should read --AUXILIARY--.

ON TITLE PAGE AT [56], REFERENCES CITED FOREIGN PATENT DOCUMENTS
"003969 1/1987 Japan" should be deleted.

COLUMN 1
Line 2, "AUXILLIARY" should read --AUXILIARY--;
Line 28, "increase" should read --increases--.

COLUMN 7
Line 23, "control or" should read --control of--.

UNITED STATES PATENT AND TRADEMARK OFFICE

CERTIFICATE OF CORRECTION

PATENT NO. : 5,696,547

DATED : December 9, 1997

INVENTOR(S): TOMOYUKI TAKEDA ET AL.

It is certified that error appears in the above-identified patent and that said Letters Patent is hereby corrected as shown below:

COLUMN 11

Line 22, "teh" should --the--.

Signed and Sealed this

Twenty-sixth Day of May, 1998

*Attest:*

*Attesting Officer*

BRUCE LEHMAN

*Commissioner of Patents and Trademarks*